US005324342A

United States Patent [19]

Mori et al.

[11] Patent Number: 5,324,342

[45] Date of Patent: Jun. 28, 1994

[54] METHOD OF REFINING MOLTEN CHROME STEEL

[75] Inventors: Hiroshi Mori, Chita; Motoshi Shinkai, Shibukawa; Junichi Tsubokura, Chita, all of Japan

[73] Assignee: Daidotokushuko Kabushikikaisha, Japan

[21] Appl. No.: 866,949

[22] Filed: Apr. 9, 1992

Related U.S. Application Data

[63] Continuation of Ser. No. 503,019, Apr. 2, 1990, abandoned.

[30] Foreign Application Priority Data

Apr. 18, 1989 [JP] Japan ..... 1-98473
Oct. 27, 1989 [JP] Japan ..... 1-280809

[51] Int. Cl.[5] ..... C21C 7/06
[52] U.S. Cl. ..... 75/512
[58] Field of Search ..... 75/512

[56] References Cited

U.S. PATENT DOCUMENTS 4,174,212 11/1979 Bauer et al. ..... 75/512
4,410,359 10/1983 Bishop, Jr. ..... 75/512
4,426,224 1/1984 Shimme et al. ..... 75/512
4,514,220 4/1985 Tommaney et al. ..... 75/557
4,615,730 10/1986 Tommaney ..... 420/71
5,047,081 9/1991 Tanabe et al. ..... 75/512

*Primary Examiner*—Melvyn J. Andrews
*Attorney, Agent, or Firm*—William A. Drucker

[57] ABSTRACT

Mixed gas of nonoxidizing gas and oxygen is blown into molten chrome steel in a vessel. The molten chrome steel is stirred by the gas and is decarbonized by the oxygen in the gas while being stirred. After the carbon potential in the molten chrome steel has been lowered, the pressure inside the vessel is reduced and the nonoxidizing gas alone is blown as the gas. Bubbles of the gas blown into the molten chrome steel become large on account of reduced pressure and exhibit sufficient stirring function. Consequently, the molten chrome steel is effectively stirred and the decarbonizing reaction is prompted.

1 Claim, 4 Drawing Sheets

FIG. 2

START OF REFINEMENT PROCESSING — THROW IN OF REDUCING AGENT (Fe-Si) — COMPLETION OF REFINEMENT PROCESSING

| | ATMOSPHERIC PROCESSING | | | VACUUM PROCESSING | ATMOSPHERIC PROCESSING |
|---|---|---|---|---|---|
| | DECARBURIZATION PERIOD | | | | REDUCTION PERIOD |
| OXYGEN/ARGON | 6/1 | 3/1 | 1/1 | ARGON STIRRING *1 | ARGON STIRRING |
| DEGREE OF VACUUM(Torr) | 760 | | | 90 | 760 |
| TIME(MINUTES) | 20 | | | 5 | 5 |

CARBON POTENTIAL PERCENTAGE(%) 1.20 → 0.15 → 0.04 → 0.04

CHROME POTENTIAL PERCENTAGE(%) 18.20 → 17.20 → 17.20 → 18.20

[*1 FLOW RATE:0.3Nm³/MINUTES·TON]

FIG. 5

START OF REFINEMENT PROCESSING — THROW IN OF REDUCING AGENT(Fe-Si) — COMPLETION OF REFINEMENT PROCESSING

| | ATMOSPHERIC PROCESSING | | | VACUUM PROCESSING |
|---|---|---|---|---|
| | DECARBURIZATION PERIOD | | | DECARBURIZATION AND REDUCTION PERIOD |
| OXYGEN/ARGON | 6/1 | 3/1 | 1/1 | ARGON STIRRING *2 |
| DEGREE OF VACUUM(Torr) | 760 | | | 90 |
| TIME(MINUTES) | 20 | | | 5 |

CARBON POTENTIAL PERCENTAGE(%) 1.20 → 0.15 → 0.04

CHROME POTENTIAL PERCENTAGE(%) 18.20 → 17.20 → 18.20

[*2 FLOW RATE:0.3Nm³/MINUTES·TON]

FIG. 10 prior art

START OF REFINEMENT PROCESSING — THROW IN OF REDUCING AGENT(Fe-Si) — COMPLETION OF REFINEMENT PROCESSING

| | ATMOSPHERIC PROCESSING | | | | | |
|---|---|---|---|---|---|---|
| | DECARBURIZATION PERIOD | | | | | REDUCTION PERIOD |
| OXYGEN/ARGON | 6/1 | 3/1 | 1/1 | 1/3 | *3 | ARGON STIRRING |
| TIME(MINUTES) | 29 | | | | | 5 |

CARBON POTENTIAL PERCENTAGE(%) 1.20 → 0.04 → 0.04

CHROME POTENTIAL PERCENTAGE(%) 18.20 → 16.90 → 18.20

[*3 ($O_2$+Ar) FLOW RATE:1Nm³/MINUTES·TON]

METHOD OF REFINING MOLTEN CHROME STEEL

This application is a continuation, of application Ser. No. 07/503,019, filed Apr. 2, 1990, now abandoned.

BACKGROUND OF THE INVENTION

1. Field of the Invention

This invention relates to a method of refining molten chrome steel to decarbonize molten chrome steel into extremely low-carbon chrome steel.

2. Description of the Prior Art

As a method of refining molten chrome steel, the following one is known. As shown in FIG. 9, molten chrome steel 2 is put into a fluxing furnace 1 shown as an example of a vessel. The decarburization, i.e., the refining of the molten chrome steel 2 is carried out in accordance with a process shown in FIG. 20 while mixed gas of nonoxidizing gas, for example, argon and oxygen is being blown into the molten chrome steel 2 through a tuyere 3 provided at the bottom portion of the furnace 1. Since the carbon potential in the molten chrome steel is initially high when the molten steel is decarbonized as mentioned above, the decarburization is carried out with a high oxygen percentage in the mixed gas. The decarburization is carried out, for example, with a mixture ratio 6:1 of oxygen and argon. As the decarburization proceeds and the carbon potential in the molten steel becomes low, the oxygen percentage is decreased. Namely, the ratio of oxygen and argon is successively varied such as 3:1, 1:1 and so on.

In a process where the carbon potential in the molten chrome steel in this prior art method of refining molten chrome steel is high as is mentioned above, the ratio of oxygen and argon is 6:1, 3:1 or 1:1 and the oxygen percentage is relatively high. Consequently, the molten chrome steel can be decarbonized efficiently and swiftly by the sufficient oxygen present in the mixed gas.

However, in the final process of decarburization where the carbon potential is low, the degree of oxidization by the oxygen contained in the mixed gas blown in is increased. Accordingly, the oxygen percentage in the mixed gas need be much decreased. Thus the ratio of oxygen and argon is set equal to 1:3 and the oxygen percentage is extremely decreased. Therefore the rate of the decarbonizing reaction becomes slow and it takes a long time to attain a prescribed low carbon potential (for example 0.04%). This fact makes long (for example 29 minutes) the period of time in which the decarburization has been completed. Moreover, since the argon percentage is increased as is mentioned above in the final process of decarburization requiring a long time, the consumption of expensive argon becomes very much. Furthermore, since oxygen is still used in the final process though with the increased argon percentage, the oxidization loss of chrome by the oxygen occurs as well. The chrome potential becomes a low value, for example, 16.9%. Accordingly, a large amount of reducing agent was necessary in the past in order to increase the chrome potential to an appropriate value, for example, 18.2%.

SUMMARY OF THE INVENTION

Thus an object of the present invention is to provide a method of refining molten chrome steel by which firstly whole the process of refining can be swiftly carried out, secondly the consumption of expensive argon can be made very little and thirdly the amount of reducing agent consumed in order to make appropriate the chrome potential is decreased.

According to the present invention, gas is blown into molten chrome steel contained in a vessel and the molten chrome steel is decarbonized. Mixed gas of nonoxidizing gas and oxygen is blown in as the above mentioned gas in the process of decarburization where the carbon potential in the molten chrome steel is high in such a degree that the carbon in the molten chrome steel is decarbonized by the oxygen in the mixed gas but the chrome in the molten chrome steel is not affected by the oxygen. Next, after the carbon potential in the molten chrome steel is lowered and the degree of oxidization of the chrome in the molten chrome steel is raised by blowing the mixed gas, the nonoxidizing gas alone is blown into the vessel at reduced pressure as the gas. Accordingly, (1a) In the process of the above mentioned high carbon potential, there is an advantage that the decarburization can be carried out swiftly and effectively by the oxygen in the mixed gas blown into the molten chrome steel.

(1b) After the carbon potential has been lowered, the gas is blown in at reduced pressure. There appears thus a decarbonizing reaction due to mixing of the molten chrome steel and slug. Moreover, since the reaction proceeds at reduced pressure, gas bubbles become large. Therefore the gas can thoroughly stir the molten chrome steel. Accordingly, the decarbonizing reaction becomes very active. As a result, there is an advantage that the molten chrome steel can be decarbonized in a short period of time to molten steel of a prescribed low carbon potential.

(1c) Namely, the present invention has an advantage that the whole process of refining can be carried out in a short period of time.

(2) According to the present invention, the nonoxidizing gas alone is used after the carbon potential in the molten chrome steel has been lowered as mentioned above. The bubbles of the gas blown in, however, become large and have an enhanced stirring faculty since the pressure inside the vessel is reduced. Accordingly, a stirring operation sufficient to maintain the above mentioned rate of decarbonizing reaction can be obtained with a small amount of gas. This fact and the advantage of (1b), i.e., the short period of time required for decarburization lead to the reduction of the consumption of the expensive nonoxidizing gas.

(3) In the process after the carbon potential in the molten chrome steel has been decreased, the chrome becomes easy to be oxidized. The nonoxidizing gas is used, however, in this process. Accordingly, there is an effect that the oxidization loss of chrome can be removed and the chrome potential in the molten chrome steel can be maintained high. This fact results in a feature that when the chrome potential in the molten chrome steel is raised to an appropriate value by the use of a reducing agent, a small amount of the reducing agent is sufficient to reduce the small amount of chrome oxide produced by blowing the mixed gas in the process where the carbon potential is high and chrome is difficult to be oxidized.

BRIEF DESCRIPTION OF THE DRAWINGS

FIG. 2 is a view showing a working process of the refinement in the first embodiment (in FIG. 2, the lapse of time is directed to the right from "start of refinement processing" to "completion of refinement processing" of the figure);

FIG. 5 is a view showing a working process of the refinement in a second embodiment (the direction of lapse of time is the same as in the case of FIG. 2);

FIG. 10 is a view showing the working process of the refinement according to the prior art method (the direction of lapse of time is the same as in the case of FIG. 2).

DESCRIPTION OF THE PREFERRED EMBODIMENTS

Figure 1:
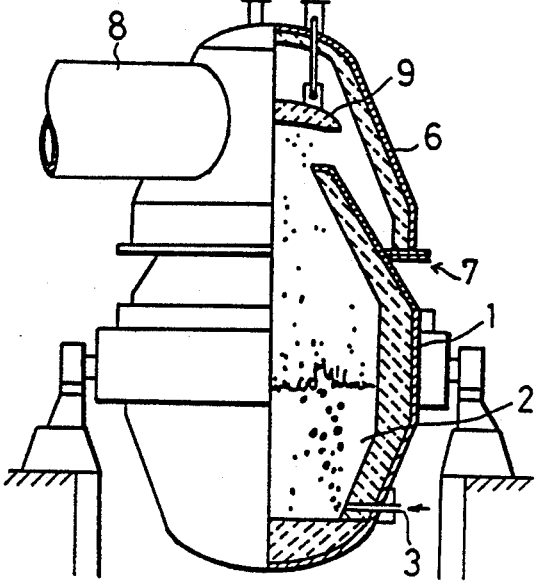
FIG. 1 is a half section showing a situation where molten chrome steel is decarbonized in a fluxing furnace at reduced pressure.
Figure 9:
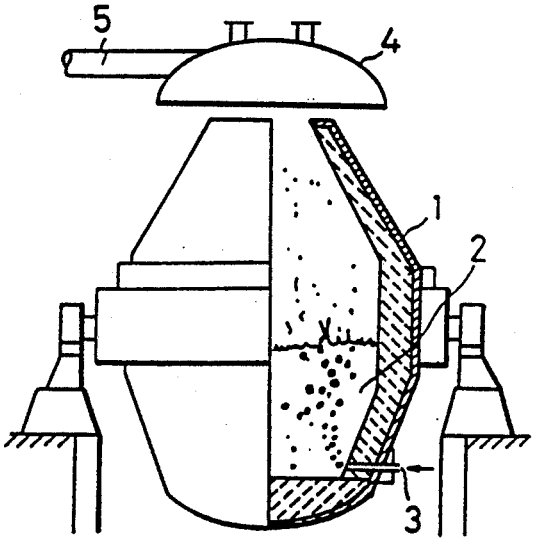
FIG. 9 (PRIOR ART)
FIG. 9 is a half section showing a situation where molten chrome steel is decarbonized in a fluxing furnace at atmospheric pressure.

A first embodiment of the present invention is described in reference to FIGS. 1, 2 and 9. First, molten chrome steel is decarbonized in the situation as shown in FIG. 9. The processing in this situation is carried out in accordance with the atmospheric processing column in FIG. 2. Namely, the molten chrome steel 2 in a fluxing furnace 1 is decarbonized by blowing mixed gas of oxygen and nonoxidizing gas such as argon (nitrogen or helium may be used as well) into the molten chrome steel through a tuyere 3 and is refined. This processing is continually carried out while the carbon potential in the molten chrome steel is high in such a degree that the carbon in the molten chrome steel is removed by the oxygen in the mixed gas but the chrome in the molten chrome steel is not affected by said oxygen. In the case of this processing, the mixture ratio of the mixed gas is at first made 6:1. As the decarburization of the molten chrome steel proceeds the carbon potential in the molten chrome steel is decreased. With the decreasing carbon potential the above mentioned mixture ratio is changed successively to 3:1, 1:1 and so on. In FIG. 9, a numeral 4 represents a hood to collect gas or dusts discharged from the furnace 1. One end of a duct 5 is connected to this hood 4 and the other end of the duct 5 is connected to a dust collector, an argon recovery apparatus and others not shown.

When the carbon potential in the molten chrome steel is decreased in the above mentioned process of refinement by decarbonizing the molten chrome steel, the rate of oxidization of the chrome in the molten chrome steel by the oxygen in the mixed gas is raised. When this situation is established a next processing is carried out in the fluxing furnace 1 at reduced pressure. The decreased carbon potential is for example 0.15%. The fact that the carbon potential has become this 0.15% can be estimated by an empirical law teaching that a prescribed processing for a certain period of time will result in a corresponding carbon potential. The above mentioned processing at reduced pressure is carried out as follows. The hood 1 is removed from the fluxing furnace 1 and a hood 6 for evacuation is instead put on the furnace 1 as shown in FIG. 1. A high temperature packing is used as a connection part 7 between this hood 6 and the fluxing furnace 1. Consequently, the sealed state inside the fluxing furnace 1 is maintained even at a high temperature. One end of a duct 8 is connected to the hood 6 and the other end of the duct 8 is connected to a vacuum exhauster not shown. A numeral 9 represents an inner lid.

After the hood 6 has been mounted the pressure inside the fluxing furnace 1 is reduced. Nonoxidizing gas such as argon alone (as other nonoxidizing gases, nitrogen, mixed gas of nitrogen and argon and helium may be used) is blown into molten chrome steel 2 through the tuyere 3. This processing is carried out for example as shown in the vacuum processing column of FIG. 2. Namely, the pressure inside the fluxing furnace 1 is made, for example, 90 Torrs and argon gas is blown in at a relatively small flow rate of 0.3 $Nm^3$/min·ton. Since the pressure is reduced in this process as mentioned above, the decarburization of the molten chrome steel by slug in the furnace 1 is prompted. The decarbonizing reaction in this case is a reaction where the chrome oxide in the slug reacts with the carbon in the molten chrome steel, the chrome oxide becomes chrome and the carbon becomes carbon monoxide. When the pressure inside the furnace 1 is reduced as mentioned above, the bubbles of argon gas become large. Consequently, the argon gas, though blown in at a small flow rate, exerts a powerful stirring operation on the molten chrome steel 2. Accordingly, the molten chrome steel 2 in the fluxing furnace 1 is effectively stirred together with the slug and the above mentioned decarbonizing reaction is prompted. The period of time for the vacuum processing is, for example, 5 minutes.

The carbon potential in the molten chrome steel 2 is decreased, for example, to 0.04% by the above mentioned processing.

In the next place, after the vacuum processing has been finished, the pressure inside the furnace 1 is returned to atmospheric pressure. A reducing agent such as Fe-Si is thrown into the molten chrome steel 2. The molten chrome steel 2 with the reducing agent thrown in is stirred by the argon blown in and the oxidized chrome is reduced. The reducing agent is, for example, granular. Reducing agents of other different form can be utilized. As the result of the reduction of the oxidized chrome, the chrome potential in the molten chrome steel 2 is returned to 18.20%.

The refining work is thus finished.

When the molten chrome steel is refined in the above mentioned manner, the time required for the carbon potential in the molten chrome steel to be decreased to the above mentioned 0.04% is the sum 25 minutes of 20 minutes required to be decreased from 1.2% to 0.15% and 5 minutes from 0.15% to 0.04%. This time is shorter by 14% compared with 29 minutes in the above mentioned prior art.

The consumption of argon in the process of the vacuum processing is 0.3($Nm^3$/min·ton)×5-(min)=1.5($Nm^3$/ton). On the other hand, The consumption of argon in the corresponding process (the process where the ratio of oxygen and argon is 1:3) in the prior art of FIG. 10 is 0.75($Nm^3$/min·ton)×9-(min)=6.75($Nm^3$/ton). Namely, the consumption of argon (1.5$Nm^3$/ton) during the process of the vacuum processing in the present embodiment is ¼.5 times the consumption (6.75 $Nm^3$/ton) in the corresponding process in the prior art.

The consumption of the reducing agent is as follows. In the process of the above mentioned atmospheric processing, the chrome potential in the molten chrome steel 2 is decreased from 18.20% to 17.20%, i.e., an amount of chrome corresponding to 1% of the molten chrome steel 2 has been oxidized. On the other hand, any decrease, i.e., any oxidization of chrome does not take place in the vacuum processing. Accordingly, an amount of reducing agent is used which is sufficient to increase 17.2% to 18.2% by only 1%. This amount is much decreased compared with the mount of reducing agent required to increase 16.9% to 18,2% by 1.3% in the prior art.

Figure 3:
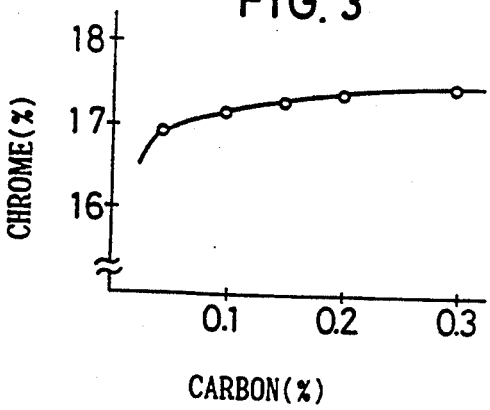
FIG. 3 is a graph showing the relationship between the carbon potential and the chrome potential in molten chrome steel.

The time when the atmospheric processing is switched over to the vacuum processing is now described. This time is preferably the time when the carbon potential in the molten chrome steel is decreased by the mixed gas blown in and the degree of oxidization of the chrome in the molten chrome steel by the oxygen in the mixed gas begins to be increased. Namely, decarburization proceeds by the mixed gas and the carbon potential is decreased. In this process, the chrome potential is decreased, for example, from 18.2% to 17.2%. Namely, the oxidization of the chrome begins to be increased. When this situation is established, the change over of the processings is carried out. From FIG. 3 (a graph showing the relationship between the carbon and the chrome in the molten chrome steel when the molten chrome steel is decarbonized at atmospheric pressure by mixed gas of oxygen and argon at a ratio of 1:3), it is found that the time for the change over is the time when the carbon potential in the molten chrome steel fails into an interval from 0.15% to 0.2%. As is clear from FIG. 3, if the carbon potential becomes less than 0.1%, it is apprehended that the degree of oxidization of the chrome is extremely raised.

Figure 4:
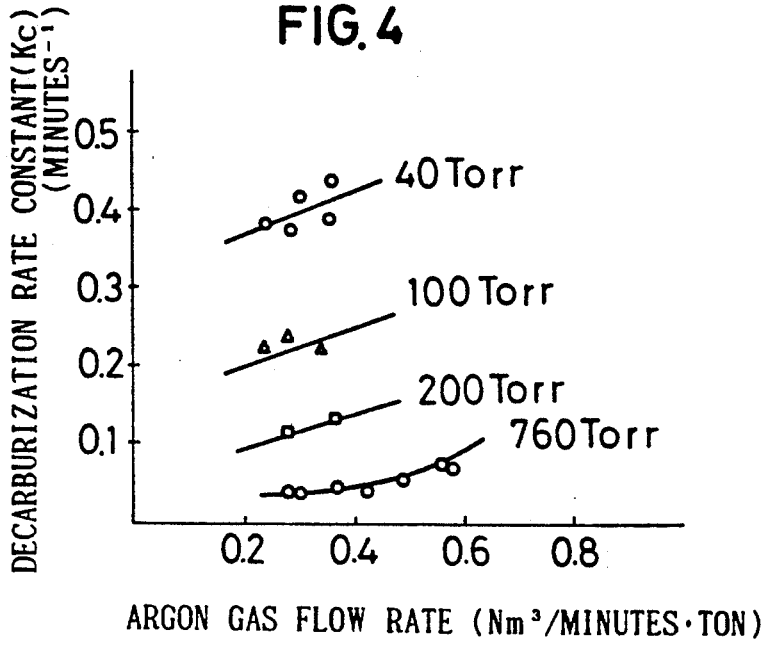
FIG. 4 is a graph showing the relationship between the flow rate of argon gas and the decarburization rate.

In the next place, FIG. 4 is a graph showing the relationship between the flow rate of argon gas and the decarburization rate constant Kc when the above mentioned vacuum processing is carried out in various degrees of vacuum.

The equation of decarburization rate can be approximated by $$-d[C]/dt \approx Kc[\%C]$$

and the larger the decarburization rate constant Kc is the more effective the decarburization is.

From the graph of FIG. 4, it can be understood that if the reduced pressure inside the fluxing furnace 1 is more than about 200 Torrs, the constant Kc becomes not much different from the value of Kc in the case of atmospheric pressure. Accordingly, the above mentioned vacuum processing is preferably carried out at a pressure less than about 200 Torrs.

If the flow rate of argon gas is greater than about 0.5 $Nm^3$/min·ton, splashes are actively scattered from the molten chrome steel and a problem occurs in operation. Thus the flow rate of argon gas is preferably less than 0.5 $Nm^3$/min·ton.

A second embodiment of the present invention is now described in reference to FIG. 5. In this embodiment, the refinement of the molten chrome steel by the use of non-oxidizing gas and the reduction of the chrome oxide by the reducing agent are concurrently at the same time in the fluxing furnance 1 at reduced pressure as shown in the vacuum processing column. In the case of the present embodiment, the atmospheric processing is carried out similarly as in the case of the first embodiment. The reducing agent is then thrown into the furnace 1 through an upper opening thereof after the atmospheric processing has been finished. Next, the pressure in the furnace 1 is reduced, for example, to 90 Torrs in the situation as shown in FIG. 1. The nonoxidizing gas such as argon is blown in at reduced pressure through the tuyere 3 and the decarburization of the molten chrome steel and the reduction of the chrome oxide are concurrently carried out. The time required for the processing is, for example, 5 minutes.

Figure 6:
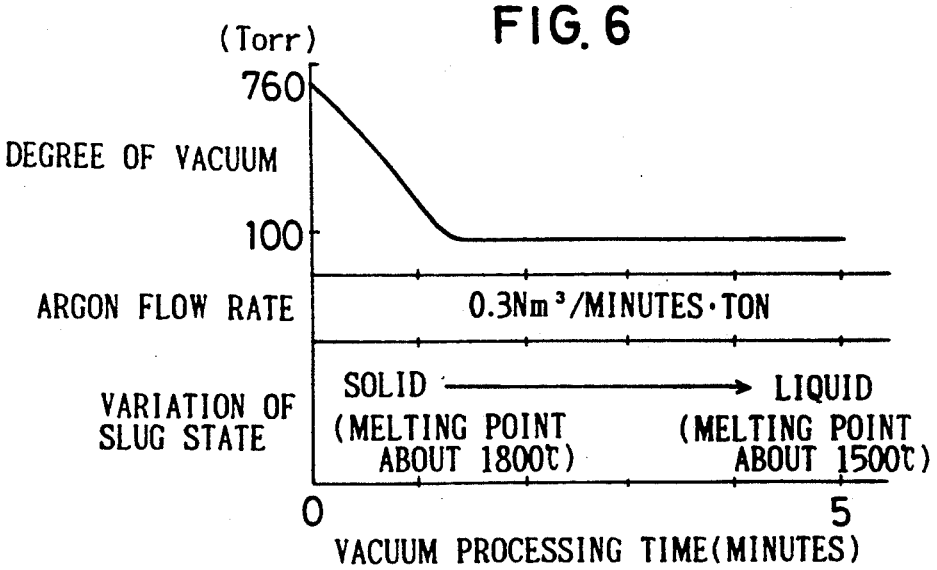
FIG. 6 is a view for explaining the variation of degree of vacuum and the variation of the state of slug in the vacuum processing of FIG. 5.

The degree of vacuum in the furnace 1 and the state of the slug in the process of the vacuum processing are as shown in FIG. 6. In this process, the slug in the furnace 1 becomes soft slug of low melting point by the added reducing agent. As the result, since the area of the boundary surface between the slug of low melting point and the molten steel is increased and stirring is effectuated at reduced pressure, the decarbonizing reaction and the reducing reaction according to the following equations (1) and (2) are prompted.

$$(Cr_2O_3)+3[C]\rightarrow 2[Cr]+3CO \quad (1)$$

$$2(Cr_2O_3)+3[Si]\rightarrow 4[Cr]+3(SiO_2) \quad (2)$$

The carbon potential in the molten chrome steel 2 is decreased, for example, to 0.04%, and the chrome potential is returned to the original value, i.e., 18.20%, by the above mentioned processing.

Since the decarburization and the reduction are concurrently carried out according to the method of FIG. 5, the following two advantages are shown. One of the advantages is to reduce the chrome oxide without prolonging the time required for refining work. The other is to decrease the amount of reducing agent required for reducing the chrome oxide.

The reducing agent may be thrown in from a throw-in means provided in the hood 6 after the hood 6 is put on the fluxing furnace 1 and the reduction of the pressure inside the fluxing furnace 1 is started. The function of the reducing agent can made more effective by doing so.

Figure 7:
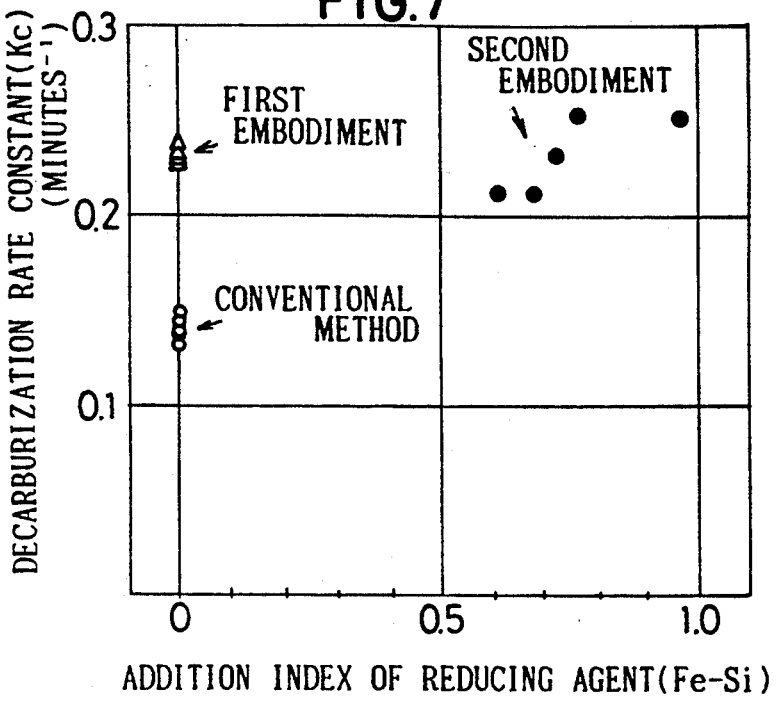
FIG. 7 is a view showing decarburization rate constants in the prior art method and in the present first and second embodiments.

Now FIG. 7 shows the decarburization rate constant for each of the methods of the first and second embodiments of the present invention and the prior art method in the working process of decarburization after the carbon potential has become 0.15%. The conditions for each of the methods of the embodiments and the prior art method are as follows. The prior art method is an operation at atmospheric pressure and the flow rate of the gas, i.e., the mixed gas of oxygen and argon is 1 $Nm^3$/min·ton. The first and second embodiments of the present invention are examples at an operating pressure of 100 Torrs and the flow rate of argon is 0.3 $Nm^3$/min·ton. The decarburization rate constant in the case of the method of the second embodiment is shown for various addition index (putting equal to unity the calculated amount of the reducing agent to be added in order to reduce all the oxidized chrome) on the abscissa.

As is clear from this FIG. 7, the method of the first embodiment provides a higher decarburization rate constant than that according to the prior art method as a result of the operation at reduced pressure. Even though the reduction of the chrome oxide concurrently proceeds according to the method of the second embodiment, a decarburization rate constant as high as that for the first embodiment is obtained.

Figure 8:
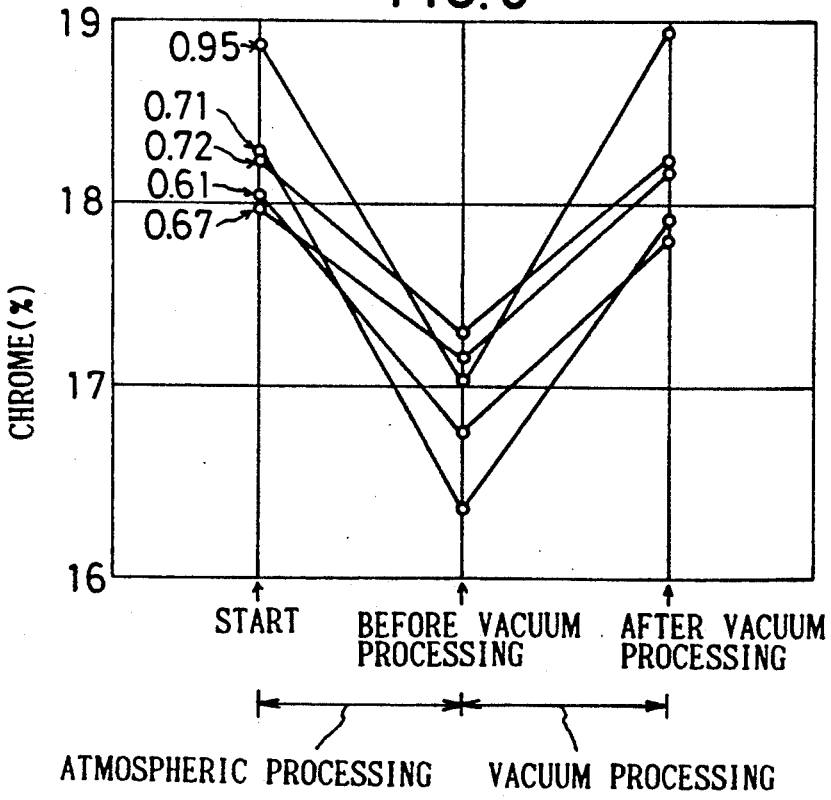
FIG. 8 is a view showing the variation of the chrome potential in the second embodiment.

Next, FIG. 8 shows the variation of chrome potentials which have been measured in various molten chrome steels with respective different content rates of chrome from the start of the refining processing work to the completion of the whole work in the second embodiment. Numerals attached to broken line graphs represent addition indexes of the reducing agent.

It is found from this FIG. 8 that approximately all the amount of chrome can be reduced even though the amount of added reducing agent is smaller than the calculated amount required to reduce all the chrome oxide. This seems to be attributed to that the carbon in the molten chrome steel reduces the chrome oxide.

It has been attempted to refine SUS 304, an example of chrome steel, by each of the methods of the first and second embodiments according to the present invention and of the prior art as shown in FIG. 10. Per unit consumptions and times required for refinement in respective methods are shown in Table 1 by comparison. Table 1 shows relative values with corresponding vales associated with the prior art put equal to 100. The prior art process till the processing by mixed gas of oxygen and argon with a mixture ratio of 1:1 has been carried out under the same conditions as those of the embodiments of the present invention and the process by mixed gas with a mixture ratio of 1:3 has been carried out under a condition of a summed flow rate of 1 $Nm^3$/min·ton of oxygen and argon.

TABLE 1

| | prior art method | first embodiment | second embodiment |
|---|---|---|---|
| oxygen u.c. | 100 | 90 | 90 |
| argon u.c. | 100 | 65 | 55 |
| reducing agent u.c. | 100 | 80 | 70 |
| total refinement time | 100 | 88 | 74 |

u.c.: unit consumption

What is claimed is:

1. A method of refining molten chrome steel contained in a vessel by decarbonizing said molten chrome steel by blowing a mixture of non-oxidizing gas and oxygen into said molten chrome steel from a tuyere provided in the side wall of the bottom portion of said vessel, including the steps of:

(a) providing a vessel with a side wall and having a tuyere in said side wall thereof.

(b) providing a molten chrome steel having a carbon potential in excess of 0.2 percent in said vessel;

(c) blowing said mixture of non-oxidizing gas and oxygen into said molten chrome steel in said vessel at atmospheric pressure until the carbon potential in said molten chrome steel is in the range from 0.2 to 0.1 percent and producing chrome oxide from the chrome steel;

(d) adding an amount of reducing agent into said molten chrome steel which is less than the theoretical amount of reducing agent necessary to reduce all of the chrome oxide produced in step (c), after said range of the carbon potential is attained; and then (e) reducing the pressure in said vessel to less than 200 Torr and simultaneously blowing only said non-oxidizing gas into said molten chrome steel from said tuyere to decarbonize said molten chrome steel until said carbon potential is decreased to from 0.1 to 0.2 percent and to reduce the chrome oxide produced in said step (c).

* * * * *